US011440688B2

(12) United States Patent
Hilbrink et al.

(10) Patent No.: US 11,440,688 B2
(45) Date of Patent: Sep. 13, 2022

(54) METHOD AND SYSTEM FOR MANUFACTURE AND FILLING WITH A STERILE LIQUID OF A TUBULAR PACKAGING

(71) Applicant: MU-DROP B.V., Apeldoorn (NL)

(72) Inventors: Hubertus Eduard Hilbrink, Apeldoorn (NL); Leonardus Hubertus Maria Lammers, Hoofddorp (NL)

(73) Assignee: MU-DROP B.V., Apeldoorn (NL)

( * ) Notice: Subject to any disclaimer, the term of this patent is extended or adjusted under 35 U.S.C. 154(b) by 152 days.

(21) Appl. No.: 16/610,952

(22) PCT Filed: May 8, 2018

(86) PCT No.: PCT/NL2018/050301
§ 371 (c)(1),
(2) Date: Nov. 5, 2019

(87) PCT Pub. No.: WO2018/208152
PCT Pub. Date: Nov. 15, 2018

(65) Prior Publication Data

US 2020/0079539 A1 Mar. 12, 2020

(30) Foreign Application Priority Data

May 8, 2017 (NL) ..... 2018872
Jun. 19, 2017 (NL) ..... 2019093

(51) Int. Cl.
*B65B 9/12* (2006.01)
*B65B 51/14* (2006.01)
(Continued)

(52) U.S. Cl.
CPC ..... *B65B 9/12* (2013.01); *B65B 9/13* (2013.01); *B65B 51/142* (2013.01);
(Continued)

(58) Field of Classification Search
CPC ..... B65B 9/12; B65B 9/13; B65B 51/142; B65B 51/225; B65B 2220/22; B65B 2051/105; B65B 31/02; B65B 55/103
See application file for complete search history.

(56) References Cited

U.S. PATENT DOCUMENTS 2,793,481 A * 5/1957 Pickering ..... B29C 65/04 53/285
2,903,829 A * 9/1959 Wolff ..... B65B 9/12 53/451
(Continued)

FOREIGN PATENT DOCUMENTS

CN 102718088 A 10/2012
CN 106143977 A 11/2016
(Continued)

OTHER PUBLICATIONS

International Preliminary Report on Patentability for the International Patent Application No. PCT/NL2018/050301, dated Nov. 21, 2019, 8 pages.
(Continued)

*Primary Examiner* — Andrew M Tecco
*Assistant Examiner* — Nicholas E Igbokwe
(74) *Attorney, Agent, or Firm* — KDB Firm PLLC

(57) ABSTRACT

A method for manufacture and filling with a sterile liquid of a tubular packaging includes: providing a container with liquid therein, providing a tube, filling the tube with the liquid from the container, dividing the tube into tubular segments by successive welding operations, and separating the tubular segments at the welded seams. After each welding operation the tube is displaced over a distance corresponding to a desired length of the tubular segments, or multiple thereof. During each welding operation pressure can be exerted locally on and energy can be supplied to the tube. Exertion of pressure and the supply of energy can be
(Continued)

Figure 1:
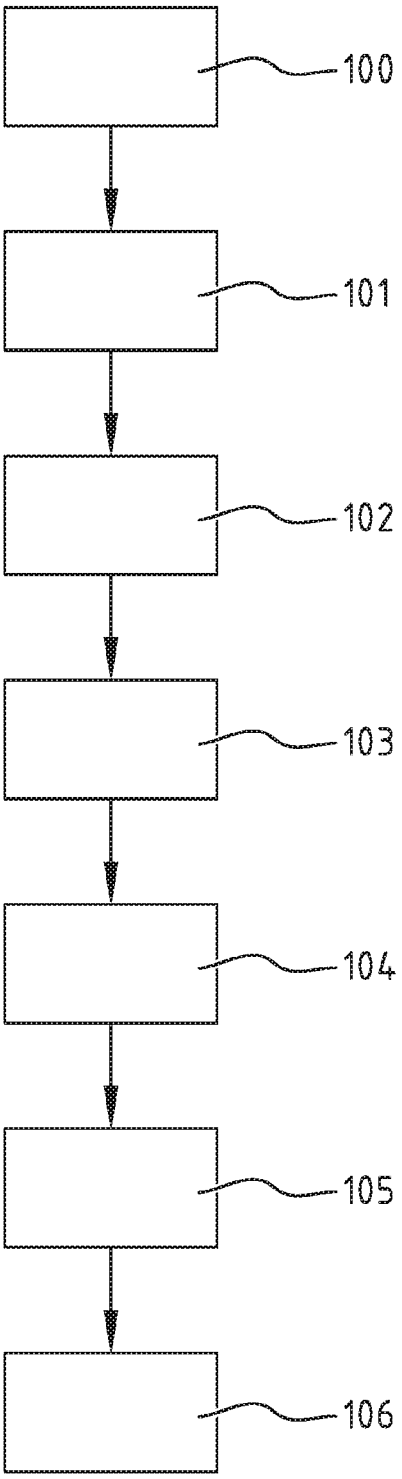

staggered in time. During each welding operation a temperature at the welded seam can be kept constant. During each welding operation a welding parameter can be measured, and the welding operation can be controlled on the basis of the measured value of the welding parameter.

21 Claims, 8 Drawing Sheets

(51) Int. Cl.
*B65B 51/22* (2006.01)
*B65B 9/13* (2006.01)
*B65B 51/10* (2006.01)

(52) U.S. Cl.
CPC ..... *B65B 51/225* (2013.01); *B65B 2051/105* (2013.01); *B65B 2220/22* (2013.01)

(56) References Cited

U.S. PATENT DOCUMENTS 3,229,442 A 1/1966 Hans
3,538,669 A * 11/1970 Broman ..... B65B 55/103 53/410
4,045,939 A * 9/1977 Baumstingl ..... B65B 31/02 53/426
4,199,915 A * 4/1980 Levine ..... B65B 3/14 141/48
2007/0262076 A1* 11/2007 Johnson ..... B65B 3/04 220/4.13
2014/0261752 A1* 9/2014 Wetsch ..... B65B 61/065 137/223
2014/0319081 A1* 10/2014 Davey ..... A61M 1/0272 210/806
2016/0083126 A1* 3/2016 Murray ..... B65B 29/10 53/451
2016/0251148 A1* 9/2016 Edwards ..... B65B 51/225 206/461

FOREIGN PATENT DOCUMENTS

DE 1027124 B 3/1958
FR 2663301 A1 12/1991
JP 3710773 B2 10/2005
JP 4554994 B2 9/2010
WO 2016035773 A1 3/2016

OTHER PUBLICATIONS

International Search Report and Written Opinion for the International Patent Application No. PCT/NL2018/050301, dated Sep. 6, 2018, 11 pages.

* cited by examiner

METHOD AND SYSTEM FOR MANUFACTURE AND FILLING WITH A STERILE LIQUID OF A TUBULAR PACKAGING

This is a national stage application filed under 35 U.S.C. § 371 of pending international application PCT/NL2018/050301 filed May 8, 2018, which claims priority to Netherlands Patent application NL 2018872, filed May 8, 2017 and Netherlands Patent application NL2019093, filed Jun. 19, 2017, the entirety of which applications are hereby incorporated by reference herein.

The invention relates a method for manufacture and filling with a sterile liquid of a tubular packaging, comprising the steps of providing a container with the sterile liquid therein, providing a tube, filling the tube at least partially with the sterile liquid in sterile manner from the container, dividing the tube into a number of tubular segments by means of successive welding operations, and separating the tubular segments from each other at the position of welded seams formed by the welding operations. Such a method is known from the American patent publication US 2014/319081 A1.

This prior patent publication describes a method for making and packaging autologous serum products. These are in particular autologous serum eye drops. When a doctor determines that a patient requires eye drops, blood is here taken from this patient and serum is separated therefrom. This serum is carried from a plastic bag into a tube, and this tube filled with serum is divided into segments, which are closed on either side, by sealing. These segments can be detached from each other and packaged in bundles. After being separated from the blood, the serum is diluted. Each tubular segment contains a portion of diluted serum.

In known methods the tube is fed to a welding device manually. The known welding devices used herein are particularly suitable for small-scale application and have a limited capacity. When large numbers of welds have to be made in succession, the welding electrodes heat up and the welded seams will not be consistent. The welded seams will then not be of uniform thickness, and will sometimes even be so thin that arcing may occur. In addition, the force exerted on the tube during the welding is not clearly defined and depends also on whether a blood bag is suspended from the tube. This also results in non-uniform thickness, which in turn results in differences in the force required to separate the segments from each other. In addition, the pressure in the tube is not the same in every welding operation. Displacement of liquid in the tube will result in flow, which is accompanied by pressure build-up as a result of friction. The built-up pressure depends on the length of the tube and affects the quality of the welded connection.

Known from U.S. Pat. No. 2,793,841 A is a method and device for forming tubular packagings which are filled with liquid. Successive welding operations are here performed on a tube filled with liquid by means of electrodes on either side of the tube, the tube is divided into a number of tubular segments, and these segments are then severed at the position of the welded seams formed by the welding operation. This document provides no indication of the way in which the tube is filled with liquid. The liquid is in any case not sterile, since an end of the tube is connected to the environment in order to allow liquid displaced by the welding operations to flow into an open container.

Further examples of forming and filling with liquid of tubular packagings are described in FR 2 663 301 A, U.S. Pat. Nos. 4,199,915 A, 2,903,829 A and WO 2016/035773 A1 (corresponding to US 2017/247130 A1).

The invention has for its object to provide a method of the above described type, wherein the above stated drawbacks do not occur, or at least do so to lesser extent. According to a first aspect of the invention, this is achieved in that, after each welding operation, the tube is displaced in controlled manner over a distance corresponding to a desired length of the tubular segments, or a multiple thereof. This controlled displacement ensures that all segments have an identical length. The forces acting on the welded seams can moreover be controlled owing to the controlled displacement.

It is even preferable that during displacement of the tube no or almost no force is exerted on the welded seam formed last.

The displacement distance can be determined here by a program or be retrieved from stored data. The length of the tubular segments can thus be varied on the basis of the desired application or the available quantity of sterile liquid. It is on the other hand also possible to envisage that the displacement distance is determined using hardware, for instance by adjusting a length of a crankshaft in a displacing mechanism.

A uniform displacement, wherein only small forces occur, is achieved when the tube is unwound from a first roll before each welding operation and wound onto a second roll after each welding operation.

According to another aspect of the invention, pressure is exerted locally on and energy is supplied to the tube during each welding operation, wherein the exertion of pressure and the supply of energy take place at least partially staggered in time. Not having the supply of energy and the exertion of pressure take place simultaneously prevents excessive deformation of the tube during the welding operation, and thereby also avoids the risk of arcing.

During each welding operation pressure is preferably first exerted locally on the tube, energy is then supplied at or close to the location where the pressure was exerted and, after interruption of the energy supply, the exertion of pressure is continued. The pressure can here be reduced or removed at times when energy is being supplied in order to compensate for the decreasing mechanical resistance against compression. By continuing the exertion of pressure once the supply of energy has been interrupted an optimal welded connection is formed.

Prior to the supply of energy, an amount of pressure which causes the tube to be pressed closed is preferably exerted locally on the tube. This ensures that enough material of the tube is included in the welding operation to ensure a good seal.

When the part of the tube which was pressed closed is compressed further after interruption of the energy supply, a very strong connection between the opposite walls of the tube is achieved here.

The local pressure on the tube is exerted by moving pressing members placed on either side of the tube toward each other. The two pressing members can here be movable, although it is also possible to envisage one of the pressing members being fixed and the other pressing member being moved toward it.

When the energy is supplied by at least one of the pressing members, the pressing members also function as electrodes.

In order to prevent arcing and sparking it is preferred for the energy to be supplied when the distance between the pressing members exceeds a determined threshold value.

Melted material of the tube is advantageously at least partially received in at least one of the pressing members during each welding operation. This prevents the melted material from inadvertently forming a bead, which could affect the strength of the weld and makes the wall thickness of the packaging non-uniform. Locally collecting the melted material enables a uniform force to be exerted on the weld, whereby an optimal entanglement of the material is achieved.

In order to ensure that the conditions are as constant as possible during each welding operation and to prevent local temperature differences it is preferred for the pressing members to be tempered.

The pressing members can here be heated or cooled as desired. The pressing members are thus kept within a narrow range of temperatures, which enhances the quality of the welded seams.

When during or after each welding operation the welded seam formed thereby is locally weakened, the tubular segments can be easily separated from each other afterwards.

The welded seam can be locally weakened in simple manner by pressing a protruding part of at least one of the pressing members into it.

The energy for the welding operation can be supplied in the form of high-frequency vibrations. This can relate to high-frequency welding or ultrasonic welding.

On the other hand, it is possible for the energy to be supplied in the form of heat, whereby a thermal welding operation can be performed.

The exertion of pressure and the supply of energy are preferably controlled on the basis of a program or stored data. A welding operation which can be readily reproduced and validated is thus achieved.

A first welding operation is preferably performed at or close to a first outer end of the tube which is connected to the container, and subsequent welding operations are performed increasingly further away from the first outer end. This prevents the sterile liquid in the tube from being pushed back in the direction of the container in successive welding operations. It is preferable here that the container is completely emptied into the tube prior to the first welding operation so that no loss of sterile liquid occurs. It is further preferred that, during filling of the tube with sterile liquid, a second outer end thereof lying opposite the first outer end remains empty. During the successive welding operations the sterile liquid is thus pushed ever further toward the free outer end, where additional tubular segments can thus still be formed.

In order to preserve the sterility of the liquid it is preferred that a filter or sterile collecting reservoir is arranged on the second outer end of the tube. In a system which is otherwise open contamination can be prevented with a filter, while with a sterile collecting reservoir a completely closed system will even be formed.

A substantial part of a length of a tubular segment is preferably closed by welding in each welding operation. The weld can have a width (defined as the distance between successive cylindrical portions filled with the sterile liquid) which amounts to substantially half or even more than half the length of a tubular segment. The width of the weld can amount to at least 20 percent, preferably at least 35 percent, more preferably at least 50 percent of the length of the tubular segment. Tubular segments with a determined length can thus still have a relatively limited volume, which is important when the sterile liquid is expensive, as is the case for serum. In addition, a wide weld also provides an optical indication that the formed packaging is small, and so nothing is being wasted. Finally, a wide weld is practical because information can be shown thereon.

A quantity of sterile liquid in the container is preferably measured, and the number of welding operations required is determined on the basis of the measured quantity and a desired quantity per tubular packaging. The number of tubular packagings and, with this, the number of welding operations can thus be predetermined, for instance by weighing the container with the sterile liquid therein. The desired values for the welding parameters can then be determined and stored in combination therewith.

When serial or parallel welding operations are performed at multiple points on the tube, the tube can be segmented relatively rapidly.

According to yet another aspect of the invention, in a method as described above at least one welding parameter is measured during each welding operation, and the welding operation is controlled on the basis of the measured value of the at least one welding parameter. By measuring a welding parameter and using this measured parameter for the purpose of controlling the welding operation, the welding operation can be adjusted to changing conditions, whereby the quality of the welded seam can remain constant. Examples of welding parameters which could be measured are the time taken up by the welding operation, the energy consumed for this purpose, the pressure exerted during the welding operation or a distance between the welding heads.

The measured value is preferably compared to a desired value and the welding operation is preferably controlled on the basis of this comparison. Variations from a desired value can thus be compensated for. The desired value of the welding parameter can here advantageously be calculated by a program or retrieved from stored data. The welding operation is thus checked against predetermined criteria.

For an optimum control, a plurality of welding parameters can be measured and be used as a basis for the control of the welding operation.

In order to also enable the quality of the welded seams and of the process to be assessed afterwards, it is preferred for the measured values of the at least one welding parameter to be stored.

According to other aspects of the invention, the presence of gas, particularly air, in the sterile liquid can be detected and the welding can be interrupted when air is detected. This prevents empty containers from being welded.

According to another aspect of the invention, a supply container is identified on the basis of a code, and all packagings are coupled to the supply container by means of a corresponding code. The first welding operation can be delayed as long as an identification code has not yet been determined.

The invention also relates to a system for manufacture and filling with a sterile liquid of a tubular packaging, comprising a sterile filling device for filling the tube at least partially with the sterile liquid from a container, a welding device for dividing the tube into a number of tubular segments by means of successive welding operations, and a separating device for separating the tubular segments from each other at the position of welded seams formed by the welding operations. Such a system is implicitly described in the above stated document US 2014/319081 A1.

According to a first aspect, the invention is distinguished from this known system by displacing means co-acting with the welding device for displacing the tube over a distance corresponding to a desired length of the tubular segments after each welding operation.

Preferred embodiments of the system according to this aspect of the invention are described in the dependent claims.

According to another aspect, the system according to the invention is distinguished from the known system in that the welding device comprises pressure exerting means and energy supply means for exerting pressure locally on and supplying energy to the tube during each welding operation, wherein the pressure exerting means and the energy supply means can be activated at least partially staggered in time.

Preferred embodiments of the system according to this aspect of the invention form the subject matter of the dependent claims.

According to yet another aspect, the invention provides a system which is distinguished by means connected to the welding device for keeping a temperature at the position of the welded seam substantially constant during each welding operation.

Preferred embodiments of the system according to this aspect of the invention form the subject matter of the dependent claims.

According to a final aspect, the invention is distinguished by measuring means connected to the welding device for measuring at least one welding parameter during each welding operation and control means connected to the welding device and the measuring means for controlling the welding operation on the basis of the measured value of the at least one welding parameter.

Preferred embodiments of the system according to the first aspect of the invention are described in the dependent claims.

Figure 2:
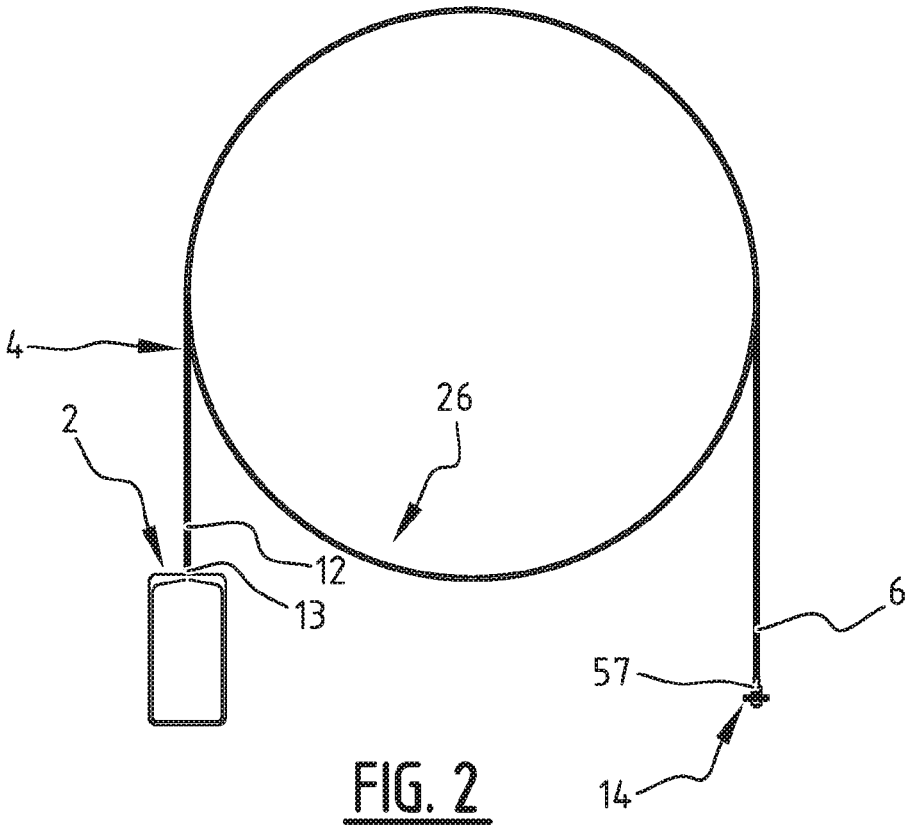
Figure 3:
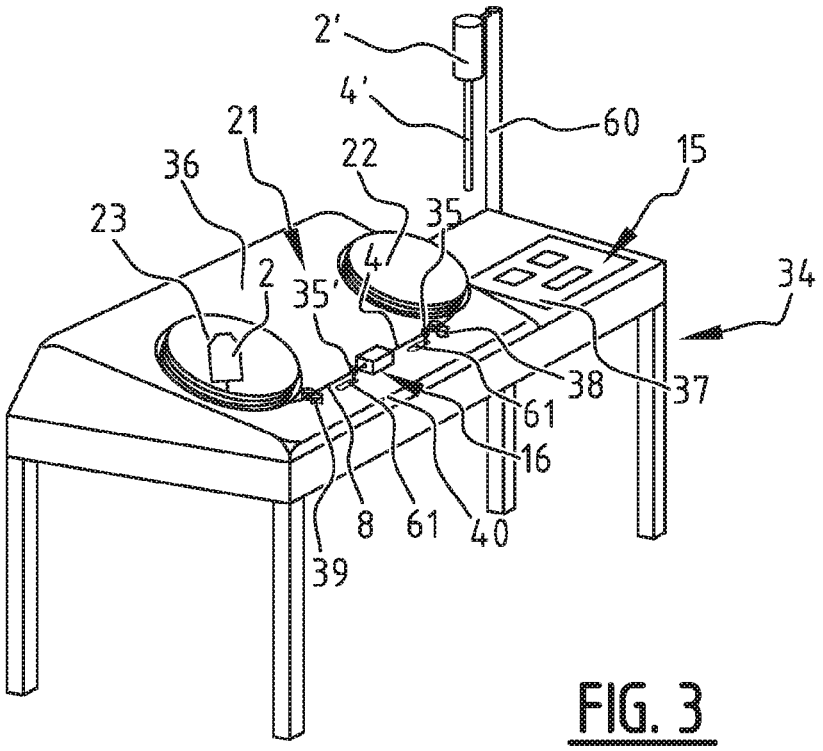
Figure 4:
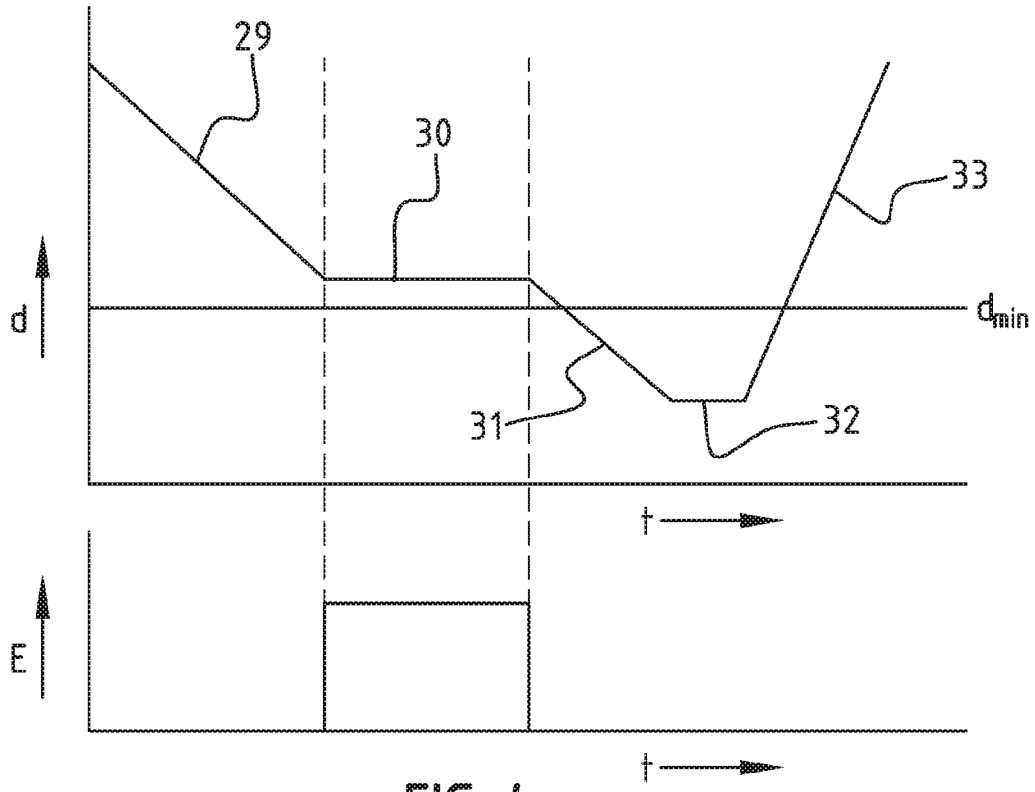
Figure 5:
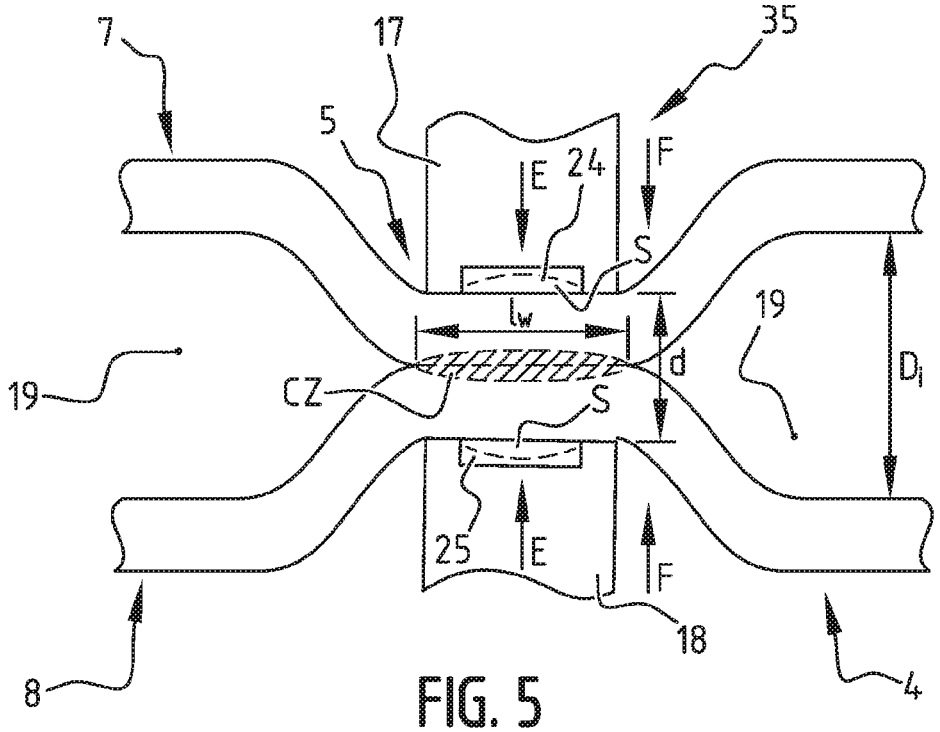
Figure 6:
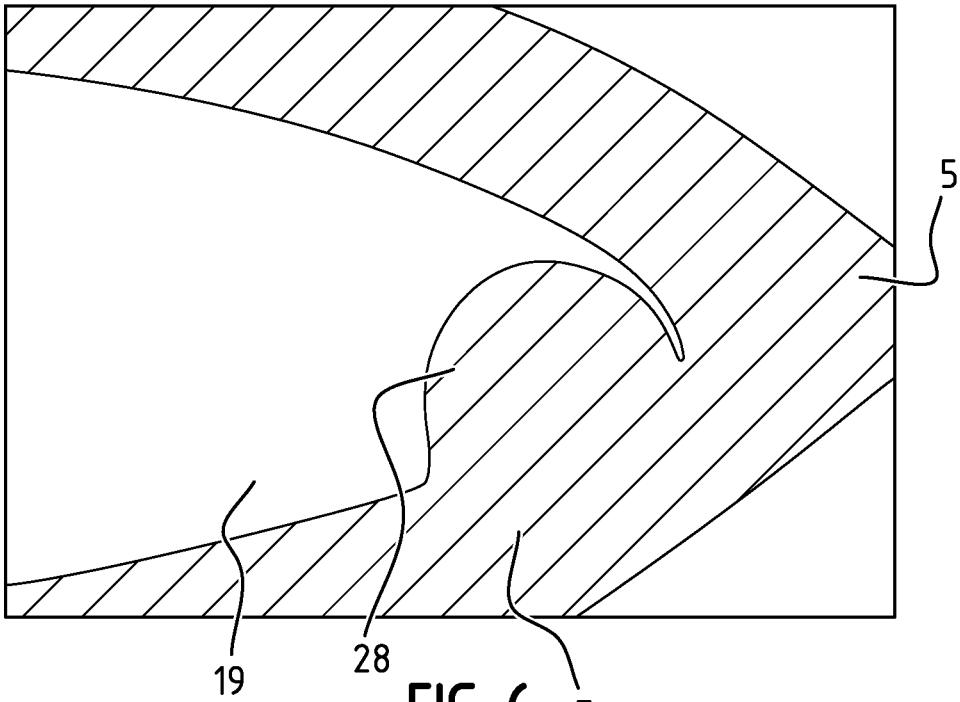
FIG. 6 (PRIOR ART)
Figure 7:
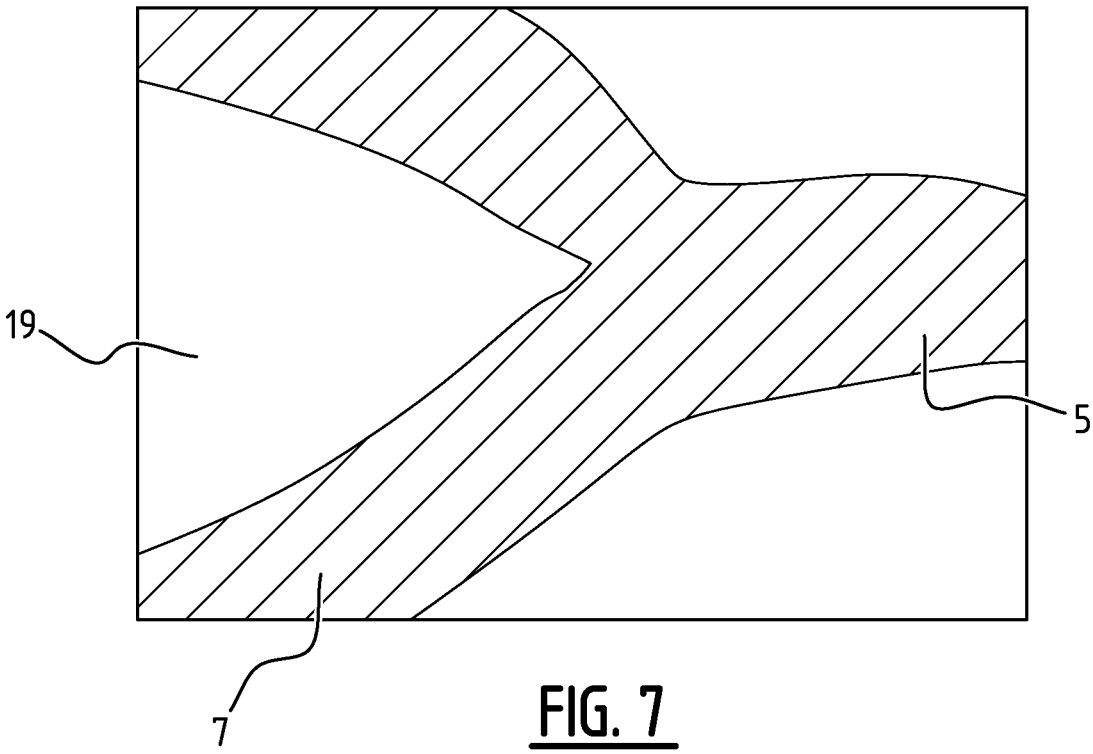
Figure 8:
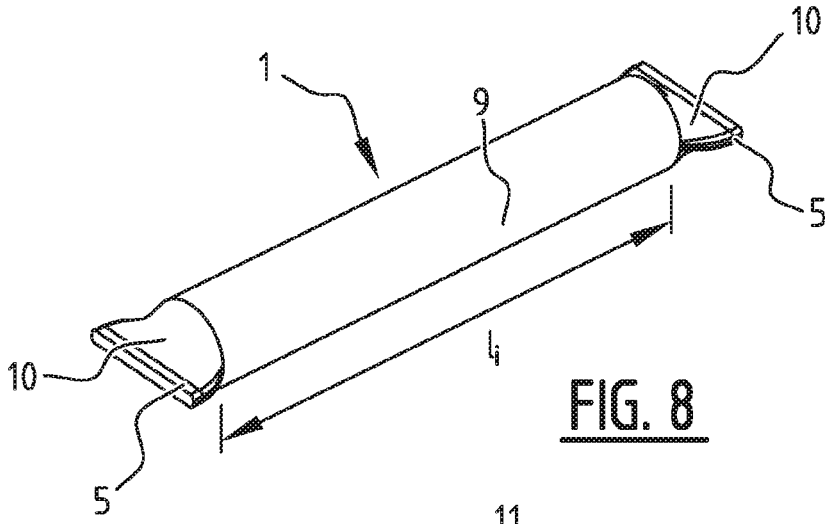
Figure 9:
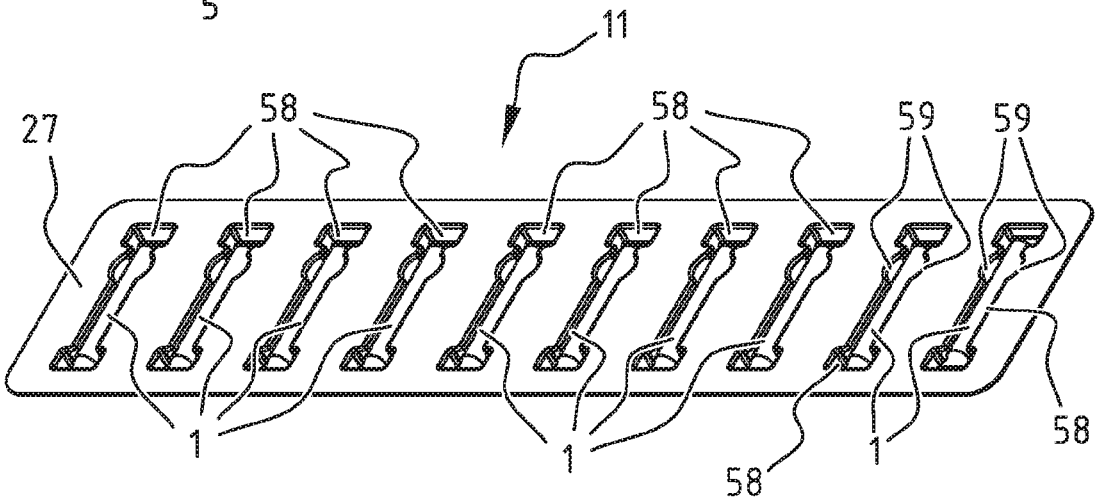
Figure 10:
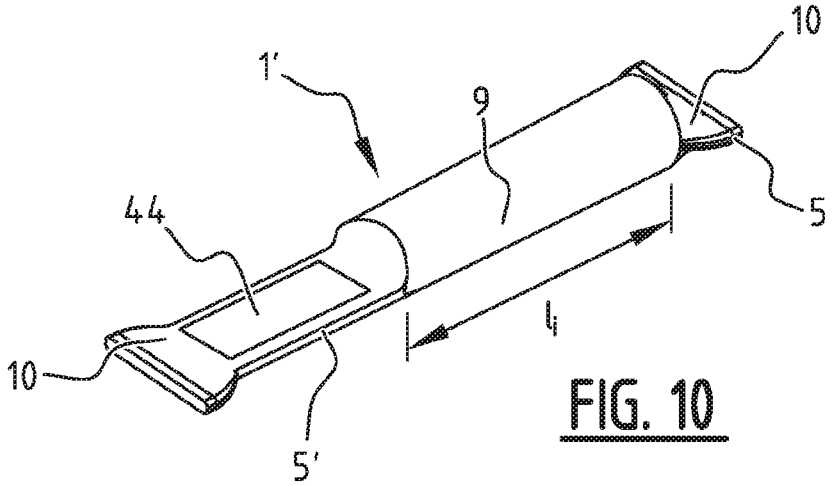
Figure 11A:
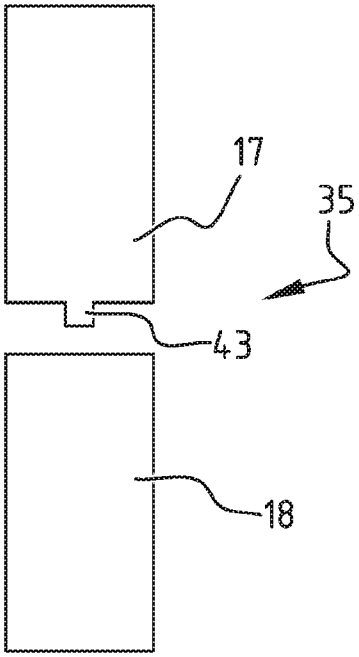
Figure 11B:
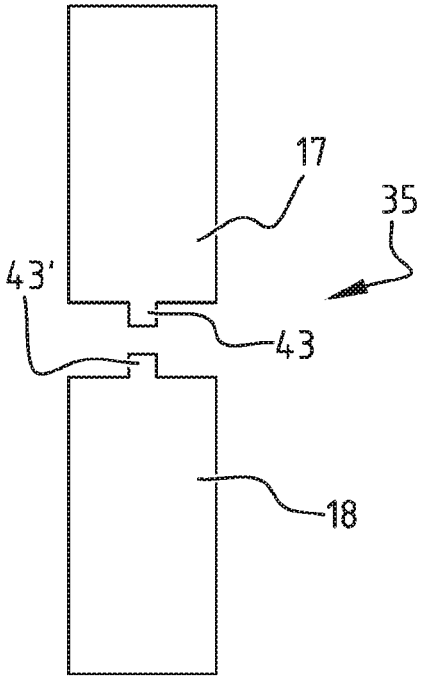
Figure 12:
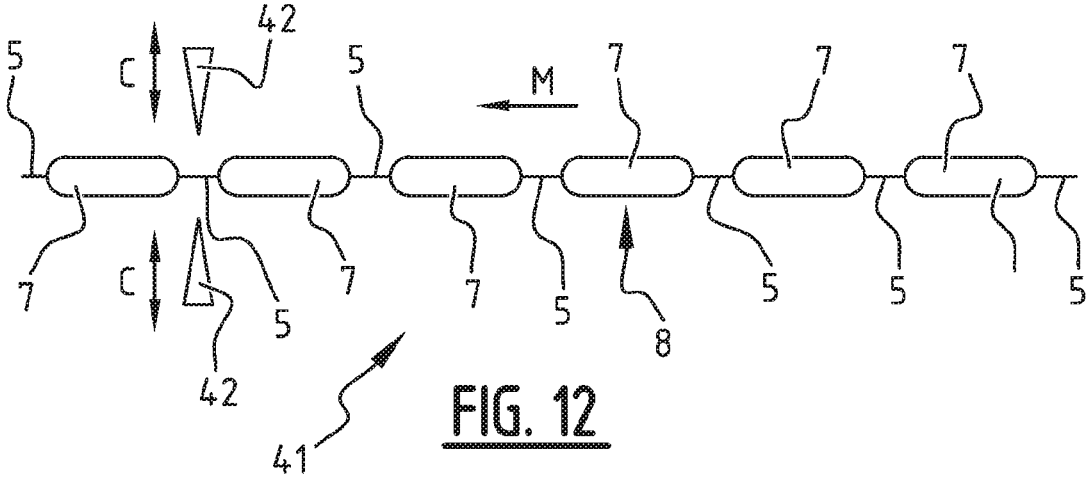
Figure 13:
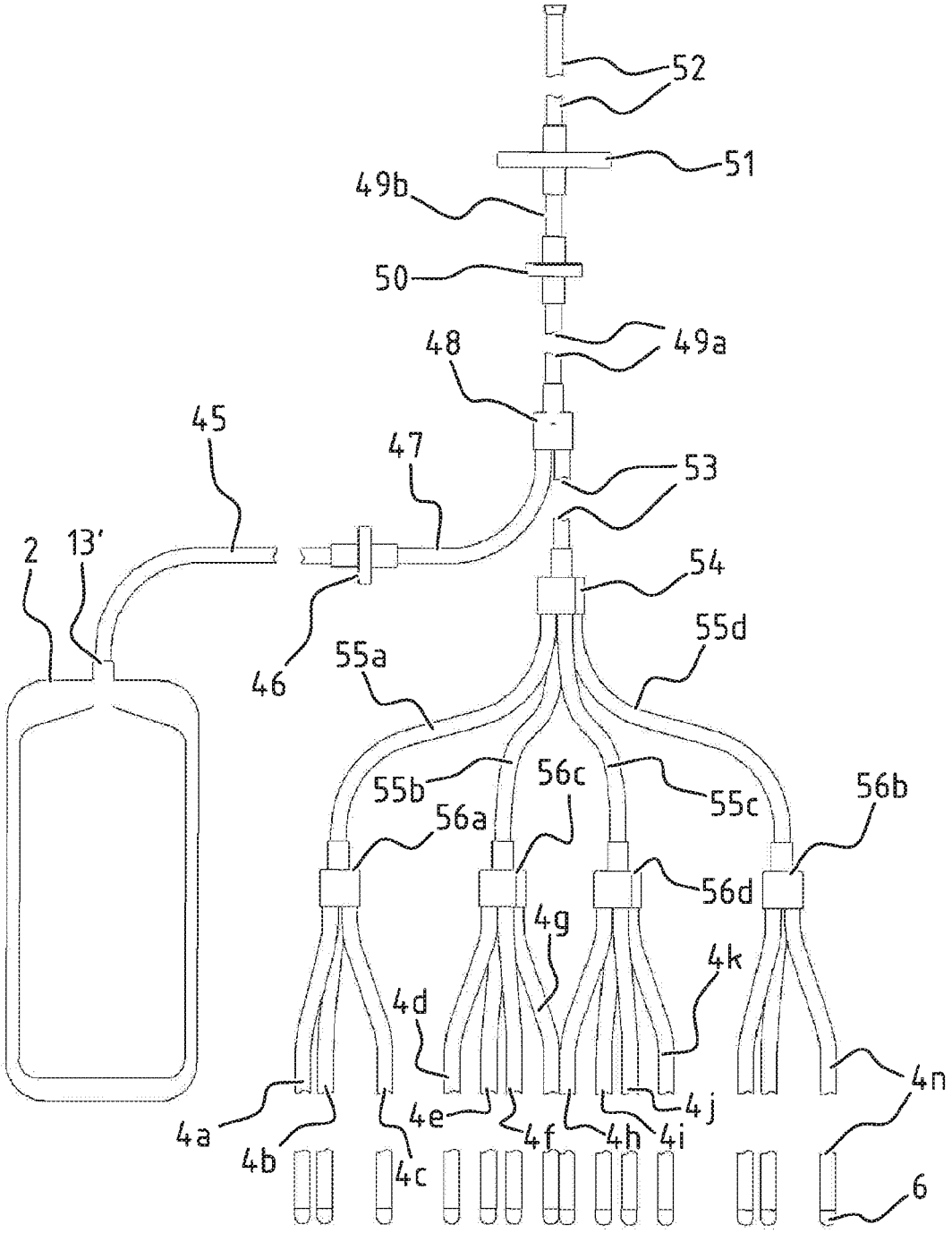
Figure 14:
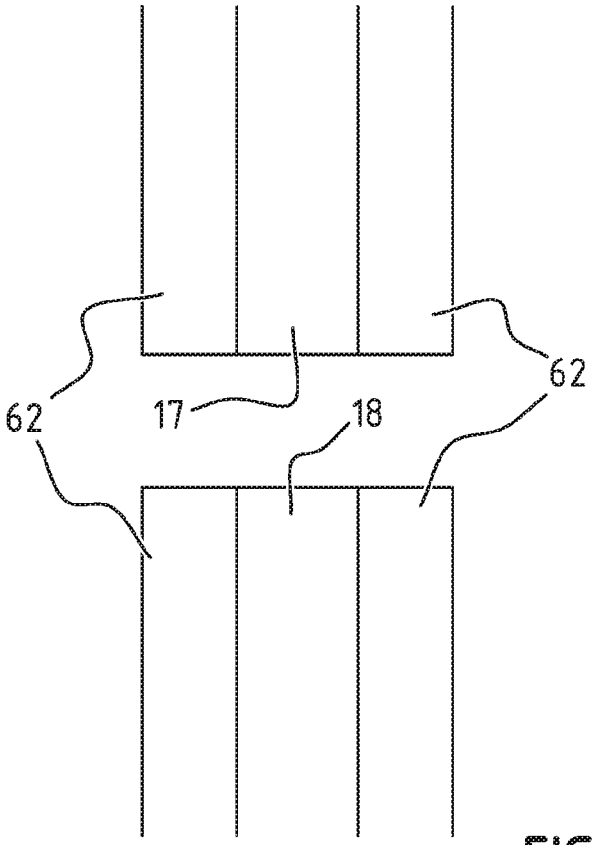

The invention will now be elucidated on the basis of a number of embodiments, wherein reference is made to the accompanying drawing, in which:

FIG. 1 is a flow chart showing the most important steps of the method according to the invention, FIG. 2 shows how a tube is filled with sterile liquid from a container, FIG. 3 is a schematic front view of a welding device with displacing means and control means, FIG. 4 is a diagram in which the movement of the welding electrodes and the energy supply are shown as a function of time, FIG. 5 is a schematic section through the tube during a welding operation, FIG. 6 shows a microscopic view of a prior art welded connection, FIG. 7 is a view corresponding to FIG. 6 of a welded connection formed by application of the method according to the invention and/or using the system according to the invention, FIG. 8 is a perspective view of a tubular packaging filled with the sterile liquid, FIG. 9 is a perspective view of a blister pack with a number of tubular packagings therein, FIG. 10 is a view corresponding to FIG. 8 of an alternative embodiment of the tubular packaging, FIGS. 11A and 11B show possible forms of electrodes of the welding device, FIG. 12 shows schematically a separating device where a string of tubular segments is separated into tubular packagings, FIG. 13 shows a view corresponding to FIG. 2 which shows how the sterile liquid is distributed over a number of tubes in an alternative embodiment, and FIG. 14 shows a schematic section through a variant of the electrodes in a thermally insulating housing.

A method for manufacture and filling with a sterile liquid of a tubular packaging 1 comprises the first step 100 (FIG. 1) of providing a container 2 with the sterile liquid 3 therein. The liquid 3 is for instance serum derived from blood. When container 2 with sterile liquid 3 is available, the quantity of sterile liquid 3 therein can be determined, for instance by means of weighing (step 101).

A tube 4 can then be selected, the length "L" and internal diameter "$D_i$" of which are such that the content of container 2 can be received therein. What's more, the internal volume selected for tube 4 is preferably greater than the content of container 2, so that the entire quantity of sterile liquid 3 can also be received in tube 4, and wastage can be prevented, when a displacing effect of the welded seams 5 to be discussed below is taken into account. Determined at the same time on the basis of the quantity of sterile liquid 3 which is available and the desired content of a tubular packaging 1 (FIG. 8) is how many of such tubular packagings 1 can be filled with the sterile liquid 3 (step 102).

Tube 4 is then filled with sterile liquid 3 from container 2 (step 103). As stated, the volume of tube 4 is selected such that the displacing effect caused by the welding operations to be discussed below is taken into account. This means that the whole content of container 2 can be received in tube 4, after which a part 6 of tube 4 still remains empty. The tube filled with sterile liquid 3 is then divided into a number of tubular segments 7 (step 104) corresponding to the calculated number of portions which can be taken from the determined volume of sterile liquid 3. The segmenting of tube 4 takes place by means of successive and/or simultaneous welding operations.

After tube 4 has been segmented, it consists of a string 8 of tubular segments 7 which are mutually connected by welded seams 5. Segments 7 can then be separated from each other at the position of these welded seams 5 (step 105). This is thus how the separate tubular packagings 1 are created. Each packaging 1 has here a cylindrical part 9 and a flat welded seam 5 on both ends 10. The thus formed tubular packagings 1 are packaged (step 106), for instance in a blister pack 11 (FIG. 9), for distribution to buyers and for later use. In order to finally dispense the sterile liquid 3 from tubular packaging 1 use can be made of a device as described in applicant's earlier application WO 2015/152721 A1. Blister pack 11 is provided for this purpose with a number of I-shaped cavities 58 in a base plate 27, in which tubular packagings 1 with their protruding welded seams 5 can be received. To enable removal of packagings 1 from blister pack 11 using the administering device according to WO721 the cavities 58 are provided with locally widened portions 59.

Container 2 can be a conventional blood bag which can be welded onto a first end 12 of tube 4 in order to bring about a sterile connection 13 (FIG. 2). The opposite free or second outer end 6 of the tube is open and is connected by means of a so-called "Luer lock" 57 to a filter 14 in order to ensure the sterility of the content. Instead of a filter 14, it is also possible for a collecting reservoir (not shown here), for instance a bag, to be attached to the second outer end 6 of tube 4 in order to achieve a completely closed system which nevertheless provides the option of filling tube 4 up to the end. It is however also possible to envisage this end 6 being closed by a simple weld (not shown here). In this case, tube 4 can however not be filled with sterile liquid 3 up to the end, since the air displaced by sterile liquid 3 will accumulate there.

Although container 2 is welded onto tube 4 in the shown example, use can also be made of a different sterile connecting technique, for instance using a "Luer lock".

The method according to the invention is distinguished in that it is suitable for application on an industrial scale. This is possible in that the different steps of the method are performed in controlled or regulated manner, under the control of a controller 15. The above discussed determining of the volume of sterile liquid 3 and the number of packagings 1 to be filled therewith can thus be performed by controller 15. This controller 15 can then select a desired tube 4 and display this selection or transmit it to an automated storage as a control signal. Controller 15 can further transmit the number of welding operations to the welding device 16 to be discussed below.

According to a possible embodiment of the invention, one or more welding parameters are measured during each welding operation, and the welding operation is controlled on the basis of this/these measured value(s). Examples of welding parameters which can be measured are the supplied energy "E", the pressure force "F" or the distance "d" between electrodes 17, 18 of welding device 16 (FIG. 5). Controller 15 can compare the measured value(s) of the welding parameter(s) E, F or d to a desired value and control the welding operation on the basis of this comparison. The desired value(s) can be calculated here by a program which is run by controller 15, or can be retrieved from data stored in a memory connected to controller 15. The measured values of the welding parameters can in turn also be stored and be used for controlling subsequent welding operations.

As stated, the number of packagings 1 which can be filled and the number of welding operations which is thus required are determined on the basis of the measured quantity of sterile liquid 3 and the known portion size, i.e. the desired content of each tubular packaging 1. At the same time an internal length "$l_i$" of each packaging 1 can be determined from the desired content of each tubular packaging 1 and the known internal diameter Di of the selected tube 4. The distance between two successive welded seams 5 can be calculated from this length $l_i$ and a known length "$l_w$" of a welded seam 5. The result of this calculation can be displayed, although it is also possible to envisage tube 4 being automatically displaced over the calculated distance.

In an embodiment of a system 20 for manufacture and filling with a sterile liquid of a tubular packaging 1 according to the invention the welding device 16 is provided with displacing means 21 co-acting therewith. These displacing means 21 serve to displace tube 4 over the calculated distance after each welding operation. In the shown embodiment displacing means 21 comprise a first roll or supply reel 22 and a second roll or take-up reel 23, which are placed on either side of welding device 16, and two transport grips 35, 35' (to be discussed below). In the shown example take-up reel 23 is a driven reel which is provided with a drive motor (not shown here). In the shown example supply reel 22 is not driven but can be provided with a brake (not shown here either) or adjustable friction element in order to adjust the tensile force on the tube 4 between supply reel 22 and take-up reel 23.

As can be seen in FIG. 2, tube 4 is supplied in the form of a roll 26, and can also be filled in rolled-up state. After filling, tube 4 can be detached from the container or blood bag 2. To this end the first end 12 of tube 4 can for instance be closed by welding, after which this end 12 closed by welding can be cut or sliced from blood bag 2. In order to prevent wastage of sterile liquid it is important that the container or blood bag 2 is completely emptied and as little sterile liquid as possible remains in the end part of tube 4 which is separated from the rest of tube 4 by the welded seam. On the other hand, air must be prevented from being entrained into the part of tube 4 which will be processed into tubular packagings 1. Before the first end 12 of tube 4 is closed by welding it can first be closed temporarily, for instance by clamping or knotting. It is not necessary though to separate container 2 from tube 4, it can also remain connected to tube 4. This is particularly advantageous since container 2 states information regarding the origin of sterile liquid 3 which is important for the identification of the packagings 1 which are ultimately filled with the sterile liquid.

When tube 4 is placed on supply reel 22, the first outer end 12 thereof is placed into welding device 16 and subjected to a welding operation. In order to guide tube 4 from the first end and along welding device 16 in controlled manner the first end 12 thereof can be connected to a lead wire (not shown here) which is wound around take-up reel 23 so that a connection is formed between tube 4 and displacing means 21. The first welded connection 5 can thus be formed directly at first end 12 of tube 4, so that no sterile liquid 3 is lost. Tube 4 can then be displaced over the desired distance after each welding operation as a result of the drive motor of displacing means 21 being driven under the influence of a signal from controller 15. When container 2 is still connected to tube 4, it can be placed on take-up reel 23 so that data regarding the sterile liquid being processed at that moment are visible and can be checked.

During each welding operation pressure is exerted on tube 4 at the indicated location, and energy is supplied to tube 4. Wall parts of tube 4 lying opposite each other are connected airtightly and liquid-tightly to each other by the combination of pressure exertion and energy supply. Pressing members of welding device 16 provide for the exertion of pressure. In the shown example the supply of energy also takes place via the pressing members, which thus function as electrodes 17, 18. These electrodes 17, 18 can be moved toward each other and apart again. One of the electrodes, for instance the lower electrode 18, can here be immobile and thus function as an anvil, while the other electrode 17 can be moved toward and away from fixed electrode 18. It is also possible to envisage both electrodes 17, 18 taking a movable form, or conversely making the upper electrode 17 stationary. The two electrodes 17, 18 together form a welding head.

In the shown example the exertion of pressure and the supply of energy take place partially staggered in time. This means that while pressure is being exerted on tube 4, no energy is supplied thereto, and, vice versa, that while the energy is being supplied, no (additional) pressure is exerted, or the pressure is even temporarily removed. This is shown in the graph of FIG. 4, which shows on the one hand the progression of the mutual distance d between electrodes 17, 18 and on the other hand the energy supply E as a function of time "t". The object of this control of the pressure exertion and the energy supply is to prevent an uncontrolled compression of the material of tube 4 from taking place due to simultaneous pressure exertion and energy supply. This is because the energy supply softens or melts the material locally, which can greatly reduce the resistance to pressure.

In the shown example a receiving space 24, 25 for melted material of tube 4 is formed in each of the electrodes 17, 18. This prevents the melt "S" from being forced out in the longitudinal direction of tube 4 and thereby forming a bead 28 in the interior 19 of the tubular packaging 1, as is the case in prior art ultrasonic welding devices (FIG. 6). After cooling, the melted material S which expands into receiving spaces 24, 25 during welding forms part of welded seam 5, so that no beads form in the interior 19 of tubular packaging 1 according to the invention (FIG. 7). The content of each packaging 1 is hereby uniform within narrow limits, which enables a precise dosage and an efficient use of the sterile liquid 3.

The progression of the welding operation is shown in FIG. 4. In the first instance the electrodes 17, 18 are moved toward each other, whereby the intermediate space d thereof decreases (line 29). During this movement the tube 4 is compressed to the point where it is substantially pressed closed in that the mutually opposite parts of the wall make contact with each other in a contact zone "CZ" (FIG. 5). When this is the case, the supply of energy is started, whereby the material of the tube becomes soft and melts at the position of electrodes 17, 18. During the supply of energy no pressure is exerted, whereby the intermediate space between electrodes 17, 18 remains substantially constant (line 30). Once the supply of energy is interrupted, electrodes 17, 18, at that point functioning only as pressing members, move closer toward each other in that they sink into the material which has become soft and/or liquid (line 31). Hereby, this material is compressed even further and an excellent entanglement is achieved in a contact zone "CZ". Finally, the movement of electrodes 17, 18 is halted by a stop (not shown here) when welded seam 5 has been compressed to sufficient extent. The pressure can then be sustained for a short while longer while the weld is cooling (line 32), after which electrodes 17, 18 are moved apart again (line 33). Controller 15 controls the movement of electrodes 17, 18 and the supply of energy to these electrodes, and ensures that energy is only supplied as long as the distance d between electrodes 17, 18 lies above a determined threshold value $d_{min}$. This prevents sparking and arcing between electrodes 17, 18.

In order to prevent the heat released during the welding from having an adverse effect on the quality of sterile liquid 3 in the tube, electrodes 17, 18 can be thermally insulated. Each electrode 17, 18 can for instance be received in an insulating housing 62 (FIG. 14) which mainly counteracts the emission of heat toward the sides, where the tube or the tube segment formed by the welding is situated. This is for instance important in the case of blood in order to prevent haemolysis—the degradation of red blood cells and the creation of free hemoglobin.

Welding device 16 is further provided with means (not shown here) for keeping the temperature at the position of the welded seam substantially constant during each welding operation. These means comprise a tempering device which can comprise one or more heating elements and one or more cooling elements. These heating and cooling elements can for instance together form a Peltier element, but the heating elements can also take a different form, for instance the form of heating resistors. Electrodes 17, 18 are kept within a narrow temperature range by means of the directed heating or cooling thereof, whereby the quality of the welded seams remains constant and a high processing speed can be achieved. Preheating of electrodes 17, 18 also preheats the material to be welded to some extent, which is favourable for the forming of the weld, and cooling electrodes 17, 18 in the interim prevents excessive heating as a result of the welding operations in rapid succession.

In the shown example welding device 16 with displacing means 21 is received in a frame 34 (FIG. 3). Supply reel 22 and take-up reel 23 are here arranged on a sloping upper surface 36 of frame 34, as are the parts of welding device 16 and displacing means 21 which act on tube 4. Controller 15 forms part of an operating unit 37 which is received in frame 34 adjacently of sloping upper surface 36. Also mounted on frame 34 is an infusion stand 60 from which a container 2' can be suspended in order to allow the sterile liquid to flow into a tube 4' (only partially shown) during filling of the tube.

In the stated example two transport grips 35, 35', which are reciprocally movable between supply reel 22 and take-up reel 23 in slots 61, are arranged on either side of welding head 16, which grips form part of displacing means 21 and the movement of which grips is synchronized with that of take-up reel 23. These transport grips 35, 35' hold tube 4 and prevent force from being exerted on the freshly formed welded seam 5. The distance between transport grips 35, 35' is kept constant when they move reciprocally in order to advance the tube/string one step, for instance because they are mechanically connected. Also arranged between supply reel 22 and first transport grip 35 is stationary grip 38, which holds tube 4 when transport grips 35, 35' release and move back tube 4 in order to fetch a subsequent segment. Arranged between the second transport grip 35' and take-up reel 23 are two guide rollers 39 which also detect a movement and, with this, the presence of string 8.

The sloping arrangement of upper plate 36 allows a user to easily monitor the welding process, while the sloping arrangement of supply and take-up reels 22, 23 and the placing of welding device 16 close to the lower edge 40 of upper surface 36 ensures that air bubbles, in the unforeseen event that they remain in tube 4, remain in the part of tube 4 which is wound onto supply reel 22 and do not reach welding device 16.

After tube 4 has been converted by the welding operations into a string 8 of mutually connected segments 7, these segments 7 can be separated from each other in a separating device 41. Such a separating device 41 can for instance be provided with cutting members or blades 42 (FIG. 12), between which the string 8 is carried in the direction of arrow M. Blades 42 are each movable toward and away from each other in the direction of arrows C and in each case cut through a welded seam 5 between two successive tubular segments 7. Separating device 41 can here likewise be provided with displacing means (not shown here) for displacing string 8 through one tube length after each cutting operation, so that the next welded seam 5 is placed in register with cutting members 42.

Instead of a cutting operation, a tearing operation could also be performed in order to separate tubular segments 7 from each other. It is practical for this purpose for the welded seam 5 between two segments 7 to already be weakened to some extent, so that it will come apart at the desired position. For the purpose of weakening the welded seam 5 at least one of the pressing members/electrodes 17, 18 can be provided with a protruding part 43 (FIG. 11A). It is also possible to envisage both pressing members/electrodes 17, 18 being provided with a protruding part 43, 43' (FIG. 11B). Welded seam 5 can thus locally be additionally compressed, whereby a very thin strip is created which will come apart easily when a tensile force is exerted thereon. Instead of a single protrusion 43 it is also possible to place a number of protrusions adjacently of each other, whereby welded seam 5 could be provided with a row of perforations. Welded seam 5 can then be torn loose, thus forming a serrated edge.

Welded seam 5 need not be very wide in order to separate two tubular segments 7 gastightly and liquid-tightly from each other. However, because the required dosage of sterile liquid 3 which will be packaged will be relatively small, the length of tubular packaging 1 could in principle be very limited. In respect of handling, it is however desirable that tubular packaging 1 is not made too small. This can be achieved by forming a relatively wide welded seam 5' between successive tubular segments 7. Use must then be made for this purpose of relatively wide electrodes. Because of the wide welded seam 5' a considerable overall length between ends 10 of tubular packaging 1' is still obtained, also in the case of a short internal length $l_i$, of cylindrical part 9', this making packaging 1' easy to handle. In addition, the short effective length of packaging 1' provides a clear image that the packaged dosage of sterile liquid 3 is small, which visualizes the fact that the sterile liquid 3 should be used responsibly. Finally, the wide welded seam 5' of tubular packaging 1' (FIG. 10) provides space for arranging for instance an information carrier 44. Welded seam 5' can thus be printed, or information can be pressed or punched therein. The information can for instance be a batch number or a best-before date.

In an alternative embodiment of the invention the sterile liquid 3 is not transferred from the container or blood bag 2 to a single, rolled-up tube, but distributed over a number of straight tubes 4*a*, 4*b*, . . . , 4*n* (FIG. 13). In the shown example container 2 is here attached by means of a glue connection 13' to a short tube segment 45, which in turn is connected to a non-return valve 46. From non-return valve 46, a short tube segment 47 runs to a Y-piece 48. From Y-piece 48, two tube segments 49*a*, 49*b* lead via a second non-return valve 50 to a hydrophilic filter 51, and ultimately to an end segment 52 which has been closed by welding. Another leg of Y-piece 48 is connected via a short tube segment 53 to a four-way manifold 54, from where four tube segments 55*a-d* run to four subsequent manifolds 56*a-d*. These are two three-way manifolds 56*a*, 56*b* and two four-way manifolds 56*c*, 56*d*. These manifolds 56*a-d* are finally connected to relatively long tubes 4*a*, 4*b*, . . . 4*n*, which are each capped at their outer end 6.

With this embodiment the tubular packagings 1 can be formed from straight tubes 4*a-n*, whereby packagings 1 themselves will also be straight. In principle, filling of the tubes 4*a-n* with the sterile liquid and segmenting of the tubes 4*a-n* takes place just as in the first embodiment. The most important difference is that tubes 4*a-n* will not be wound onto supply and take-up reels 22, 23, but will be transported linearly along welding device 16. This preserves the straight character of tubes 4*a-n* and, with this, the tubular packagings 1 formed therefrom.

The invention thus makes it possible to fill a large number of relatively small packagings with a sterile liquid, for instance serum, with relatively simple means, at relatively high speed and with relatively little effort.

Although the invention is described above with reference to a number of embodiments, it will be apparent that it is not limited thereto but can be varied in many ways within the scope of the following claims.

The invention claimed is:

1. A method for manufacture and filling with a sterile liquid of a tubular packaging, comprises:

providing a container with the sterile liquid therein, providing a tube, filling the tube at least partially with the sterile liquid, in a sterile manner, from the container, dividing the tube into a number of tubular segments by successive welding operations, and separating the tubular segments from each other at the position of welded seams formed by the welding operations, wherein after each welding operation the tube is displaced in controlled manner over a distance corresponding to a desired length of the tubular segments, or a multiple thereof; and wherein during each welding operation pressure is exerted locally on, and energy is supplied to, the tube, and wherein the exertion of pressure and the supply of energy take place at least partially staggered in time.

2. The method as claimed in claim 1, wherein during displacement of the tube at least one of:

no or almost no force is exerted on the welded seam formed last, the displacement distance is determined by a program or retrieved from stored data, and the tube is unwound from a first roll before each welding operation and wound onto a second roll after each welding operation.

3. The method as claimed in claim 1, wherein at least one of:

during each welding operation pressure is first exerted locally on the tube, energy is then supplied at or close to the location where the pressure was exerted and, after interruption of the energy supply, the exertion of pressure is continued, prior to the supply of energy an amount of pressure which causes the tube to be pressed closed is exerted locally on the tube, and the part of the tube which was pressed closed is compressed further after interruption of the energy supply.

4. The method as claimed in claim 3, wherein at least one of:

pressure is exerted locally on the tube by moving pressing members placed on either side of the tube toward each other, the energy is supplied by at least one of the pressing members, the energy is supplied when a distance between the pressing members exceeds a determined threshold value, and during each welding operation melted material of the tube is at least partially received in at least one of the pressing members.

5. The method as claimed in claim 1, wherein at least one of:

during each welding operation a temperature at the position of the welded seam is kept substantially constant, the pressing members are tempered, and the pressing members are heated or cooled.

6. The method as claimed in claim 1, wherein at least one of:

during or after each welding operation the welded seam formed thereby is locally weakened, and the welded seam is locally weakened by pressing a protruding part of at least one of the pressing members into it.

7. The method as claimed in claim 3, wherein at least one of:

the energy is supplied in the form of high-frequency vibrations or heat, and the exertion of pressure and the supply of energy are controlled on the basis of a program or stored data.

8. The method as claimed in claim 3, wherein at least one of:

a first welding operation is performed at or close to a first outer end of the tube which is connected to the container, and subsequent welding operations are performed increasingly further away from the first outer end, the container is completely emptied into the tube prior to the first welding operation, during filling of the tube with sterile liquid a second outer end thereof lying opposite the first outer end remains empty, and a filter or sterile collecting reservoir is arranged on the second outer end of the tube.

9. The method as claimed in claim 1, wherein at least one of:

a substantial part of a length of a tubular segment is closed by welding in each welding operation, a quantity of sterile liquid in the container is measured and the number of welding operations required is determined on the basis of the measured quantity and a desired quantity per tubular packaging, and serial or parallel welding operations are performed at multiple points on the tube.

10. The method as claimed in claim 1, wherein at least one of:

at least one welding parameter is measured during each welding operation, and the welding operation is controlled on the basis of the measured value of the at least one welding parameter, the measured value is compared to a desired value and the welding operation is controlled on the basis of this comparison, and the desired value of the welding parameter is calculated by a program or retrieved from stored data.

11. The method as claimed in claim 10, wherein at least one of:

a plurality of welding parameters is measured and used as a basis for the control of the welding operation, and the measured values of the at least one welding parameter are stored.

12. A system for manufacture and filling with a sterile liquid of a tubular packaging, comprising:

a sterile filling device for filling the tube at least partially with the sterile liquid from a container, a welding device for dividing the tube into a number of tubular segments by successive welding operations, the welding device comprising a pressure exerting mechanism and an energy supply for exerting pressure locally on and supplying energy to the tube during each welding operation, a separating device for separating the tubular segments from each other at the position of welded seams formed by the welding operations, and a displacing mechanism co-acting with the welding device for displacing the tube over a distance corresponding to a desired length of the tubular segments, or a multiple thereof, after each welding operation, wherein the pressure exerting mechanism and the energy supply of the welding device can be activated at least partially staggered in time.

13. The system as claimed in claim 12, wherein at least one of:

the displacing mechanism is configured to move the tube without or almost without exerting pressure on the welded seam formed last, the displacing mechanism comprises engaging members placed on either side of the welded seam, the displacing mechanism is connected controllably to a controller, and the displacing mechanism comprises a first roll and a second roll which are placed on different sides of the welding device, wherein at least one of the rolls is drivable.

14. The system as claimed in claim 12, wherein at least one of:

the welding device is configured to activate the pressure exerting mechanism and the energy supply in succession during each welding operation, and to activate the pressure exerting mechanism after deactivation of the energy supply, and the pressure exerting mechanism comprises pressing members which are placed on either side of the tube and are movable relative to each other.

15. The system as claimed in claim 14, wherein at least one of:

the pressing members are configured to supply energy to the tube and function as electrodes forming part of the energy supply, and the welding device is configured to interrupt supplying energy when a distance between the pressing members exceeds a determined threshold value, at least one of the pressing members comprises a receiving space for melted material of the tube, and at least one of the pressing members comprises a protruding part.

16. The system as claimed in claim 14, wherein:

the energy supply is configured to generate high-frequency vibrations, or at least one of:

the energy supply is configured to generate heat, a thermal insulator is present for thermally insulating the energy supply, and the pressure exerting mechanism and the energy supply are connected controllably to the controller.

17. The system as claimed in claim 12, further comprising a thermal regulator connected to the welding device for keeping a temperature at the position of the welded seam substantially constant during each welding operation, wherein the thermal regulator comprises a tempering device co-acting with the pressing members, wherein the tempering device comprises at least one heating element and at least one cooling element, and wherein the at least one heating element and the at least one cooling element together form a Peltier element.

18. The system as claimed in claim 12, wherein the welding device is configured to perform serial or parallel welding operations at multiple points on the tube.

19. A system for manufacture and filling with a sterile liquid of a tubular packaging, comprising:

a sterile filling device for filling the tube at least partially with the sterile liquid from a container, a welding device for dividing the tube into a number of tubular segments by successive welding operations, a separating device for separating the tubular segments from each other at the position of welded seams formed by the welding operations, a displacing mechanism co-acting with the welding device for displacing the tube over a distance corresponding to a desired length of the tubular segments, or a multiple thereof, after each welding operation, and a measuring device connected to the welding device for measuring at least one welding parameter during each welding operation, wherein a controller is connected to the welding device and the measuring device for controlling the welding operation on the basis of the measured value of the at least one welding parameter.

20. The system as claimed in claim 19, wherein at least one of:

the controller is configured to compare the measured value to a desired value and to control the welding operation on the basis of this comparison, the controller is configured to calculate the desired value of the welding parameter with a program or to retrieve the desired value from stored data, the measuring device is configured to measure a plurality of welding parameters and the controller is configured to use a plurality of measured values as a basis for the control of the welding operation, and a data storage is connected to the measuring device and the controller for storing the measured values of the at least one welding parameter.

21. A method for manufacture and filling with a sterile liquid of a tubular packaging, comprising:

providing a container with the sterile liquid therein, providing a tube, filling the tube at least partially with the sterile liquid, in sterile manner, from the container, dividing the tube into a number of tubular segments by means of successive welding operations, and separating the tubular segments from each other at the position of welded seams formed by the welding operations, wherein after each welding operation the tube is displaced in controlled manner over a distance corresponding to a desired length of the tubular segments, or a multiple thereof, and wherein at least one welding parameter is measured during each welding operation, and the welding operation is controlled on the basis of the measured value of the at least one welding parameter.

* * * * *